US006502701B2

(12) United States Patent
Shinada

(10) Patent No.: US 6,502,701 B2
(45) Date of Patent: Jan. 7, 2003

(54) PACKAGE FOR INK CARTRIDGE AND METHOD FOR PACKING CARTRIDGE

(75) Inventor: Satoshi Shinada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/803,644

(22) Filed: Mar. 12, 2001

(65) Prior Publication Data

US 2001/0032799 A1 Oct. 25, 2001

(30) Foreign Application Priority Data

Mar. 10, 2000 (JP) ..... 2000-067381

(51) Int. Cl.[7] ..... B65D 81/02
(52) U.S. Cl. ..... 206/723; 206/461; 206/722
(58) Field of Search ..... 206/207, 461, 206/462, 467, 701, 722, 723, 460; 347/86, 87

(56) References Cited

U.S. PATENT DOCUMENTS 5,131,539 A * 7/1992 Karita et al. ..... 347/87
5,231,416 A * 7/1993 Terasawa et al. ..... 206/723
5,262,802 A * 11/1993 Karita et al. ..... 347/87
5,279,410 A * 1/1994 Arashima et al. ..... 206/723
5,831,652 A * 11/1998 Hinami et al. ..... 347/86
5,887,717 A * 3/1999 Anderson et al. ..... 206/460
5,934,475 A * 8/1999 Hikake et al. ..... 206/722
6,047,816 A * 4/2000 Moghadam et al. ..... 206/207
6,247,598 B1 * 6/2001 Hosaka et al. ..... 206/723
6,283,587 B1 * 9/2001 Umemura ..... 347/86
6,286,946 B1 * 9/2001 Umemura et al. ..... 347/86

FOREIGN PATENT DOCUMENTS

EP 0 626 264 A2 11/1994

* cited by examiner

*Primary Examiner*—Jim Foster
(74) *Attorney, Agent, or Firm*—Sughrue Mion, PLLC

(57) ABSTRACT

A package has a holder for holding an ink cartridge, a container for accommodating the holder, and a mount for sealing an opening of the container. The holder is made from recycled materials and the internal shape of the holder conforms to the external shape of the cartridge. The container has a transparent portion and substantially conforms to the holder. The mount is made from recycled materials. The mount is attached to the container in a depressurized environment. The cartridge is visible through the transparent portion of the container. Since the holder and the mount are made from recycled materials, the package is environmentally sound. The holder may hold a used cartridge.

25 Claims, 5 Drawing Sheets

PACKAGE FOR INK CARTRIDGE AND METHOD FOR PACKING CARTRIDGE

BACKGROUND OF THE INVENTION

The present invention relates to a package of an ink cartridge for an ink jet printing apparatus and a method for packing the cartridge.

A typical ink jet printing apparatus has a printing head, which includes nozzles for ejecting ink droplets, and an ink cartridge, which stores ink to be supplied to the printing head. The printing head has an ink ejection mechanism including a piezoelectric element or a heating element. The ejection mechanism is driven by a drive signal that corresponds to printing data, and the ink is ejected from the nozzles.

Japanese Unexamined Patent Publication No. 6-328709 discloses a package for packing an ink cartridge. The package is used for packing a unit that includes a printing head integrated with an ink cartridge. The package includes a container, which accommodates the unit, and a lid for closing an opening of the container.

FIG. 5 illustrates a package for a single unit ink cartridge 31. The ink cartridge 31, which is made of material that has a low permeability, has a ventilation hole (not shown). The ventilation hole in a new cartridge 31 is sealed with a gas impermeable film 32. Accordingly, air is prevented from entering the cartridge 31. The impermeable film 32 is removed before using the cartridge 32.

The package includes a gas impermeable bag 33 and a paper box 34. Each new cartridge 31 is hermetically sealed in the bag 33 in a depressurized environment and is accommodated in the paper box 34. Air in the cartridge 31 passes through a wall, which is made of material that has low permeability, to the bag 33, the internal pressure of which is low. Therefore, when the cartridge 31 is packed, the depressurized condition in the cartridge 31 is maintained. Depressurization of the cartridge improves the initial printing performance. When the depressurized cartridge 31 is installed in the printing apparatus, air is restricted from entering a passage (not shown) between an ink supply port and a printing head.

However, the conventional packing method, which is described above, has the following disadvantages.

After being packed, the cartridge 31 in the bag 33 is not visible. Accordingly, when purchasing a new ink cartridge, purchasers have difficulty determining whether the new cartridge matches the old one. To facilitate identification of the packed cartridge 31 type, the cartridge model number or an illustration may be printed on the outside of the bag 33. However, it is impossible to clearly describe characteristics of the cartridge 31.

After an ink cartridge is taken out of a bag, the bag is unnecessary and immediately disposed of after being opened, consequently it is desired to provide products in consideration of environmental issues that have been raised recently.

Before the ink in an ink cartridge is depleted, the cartridge may be taken out of an ink jet printing apparatus. In this case, a bag may be used for temporarily storing the cartridge. However, a conventional bag is not designed to store a cartridge that contains ink.

SUMMARY OF THE INVENTION

It is an object of the present invention to make a packed ink cartridge visible through a package.

It is another object of the present invention to provide a package that minimizes adverse effects on environment.

It is a further object of the present invention to provide a package that is capable of appropriately storing a used ink cartridge that contains ink.

To achieve the above object, the present invention provides a package for an ink cartridge. The package includes a holder that holds the cartridge, a container that accommodates the holder, and a cover. The container is made of a gas impermeable material and has a transparent portion and an opening. The cover is attached to the container such that the opening of the container is hermetically sealed.

The present invention further provides a method for packing an ink cartridge. The cartridge is placed in a holder, which is placed in a container. A cover is attached to the container in a depressurized environment. An opening of the container is hermetically sealed to the cover.

BRIEF DESCRIPTION OF DRAWINGS

The invention, together with objects and advantages thereof, may best be understood by reference to the following description of the presently preferred embodiments together with the accompanying drawing in which:

FIG. 1(*b*) is a cross sectional view of the cartridge shown in FIG. 1;

FIG. 3(*b*) is a perspective view of the holder shown in FIG. 3(*a*) and viewed from the bottom;

FIG. 4(*b*) is a cross sectional view of the package shown in FIG. 4(*a*)

DETAILED DESCRIPTION OF THE PREFERRED EMBODIMENTS

An embodiment of the present invention is described according to FIG. 1(*a*) to FIG. 4(*b*) as follows.

Figure 1A:
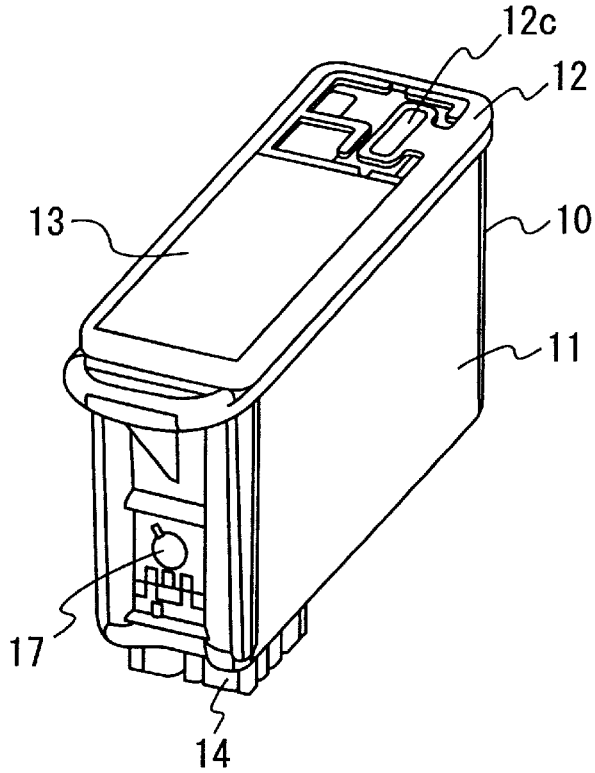
FIG. 1(*a*) is a perspective view showing an ink cartridge.
Figure 1B:
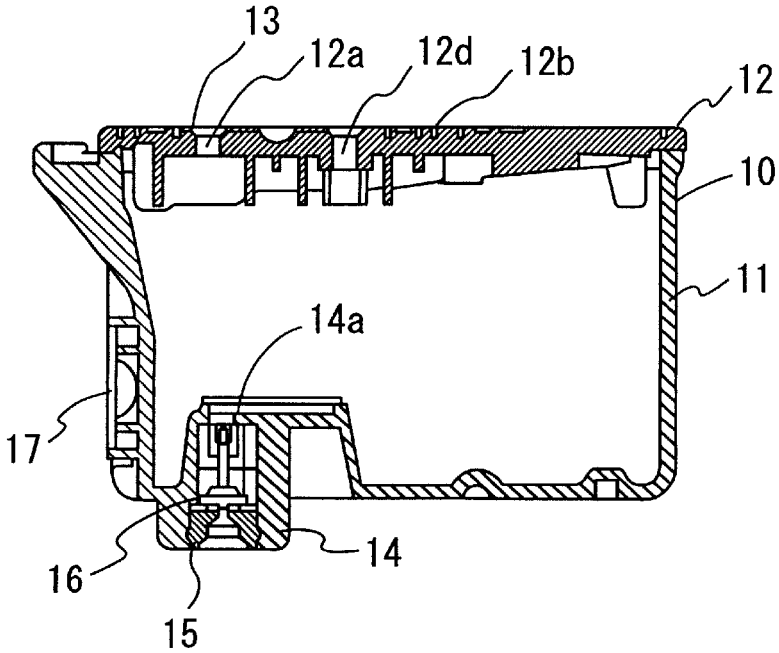

FIGS. 1(*a*) and 1(*b*) illustrate an ink cartridge 10, which is mounted on an ink jet printing apparatus (not shown). The cartridge 10 has a container 11 and a lid 12. The container 11 includes an upper opening, which is closed by the lid 12. The cartridge 10 is a rectangular parallelepiped and is made of a resin that has low permeability, such as plastic. The lid 12 includes an ink injection hole 12*a* and an air hole 12*d*. Formed on the upper surface of the lid 12 is an indentation 12*c*.

A narrow groove 12*b*, which is formed on the upper surface of the lid 12, communicates the air hole 12*d* with the indentation 12*c*. A gas impermeable film 13 is attached to the upper surface of the lid 12 and covers the ink injection hole 12*a* and the air hole 12*d*. The film 13 also covers the narrow groove 12*b*. When the film 13 is attached to the lid 12, the narrow groove 12b forms a communicating path such that the air hole 12*d* communicates with the indentation 12*c*. On the film 13, the model number and manufacturer of the cartridge 10, instructions for using the cartridge 10 and characteristics of the design of the cartridge 10 are printed.

After ink is injected from the ink injection hole 12*a* to the internal cavity of the cartridge 10, the film 13 is attached to the cartridge 10. Then, another gas impermeable film 18 (see FIG. 2) is attached to the cartridge 10 such that the film 18 covers the indentation 12*c*. When the film 18 is attached to the cartridge 10, the cartridge 10 is in a depressurized environment. Therefore, before removing the film 18, that is, when the cartridge 10 is new, the pressure inside the cartridge 10 remains lower than atmospheric pressure. The film 18 is removed from the cartridge 18 when the cartridge 10 is mounted on the ink jet printing apparatus. When the film 18 is taken off, air enters the cartridge 10 through the air hole 12*d*, the narrow groove 12*b*, and the indentation 12*c*.

As shown in FIG. 1(*b*), on the bottom of the cartridge 10, a projection 14 with an ink supply port 14*a* is formed. In the supply port 14*a*, a seal 15 and a valve mechanism 16 are formed. When the cartridge 10 is mounted on the printing apparatus, an ink supply needle (not shown), which is located in the printing apparatus, pushes and opens the valve mechanism 16. Then, the seal 15 contacts the supply port 14*a* and forms a liquid-tight seal. Accordingly, ink in the cartridge 10 is supplied to the printing apparatus through the supply port 14*a*. The seal prevents ink from leaking through the coupling between the cartridge 10 and the printing apparatus. When the cartridge 10 is not mounted on the printing apparatus, the valve mechanism 16 closes the supply port 14*a*.

At a side of the cartridge 10, a memory device, such as a random access memory 17, is located. When the cartridge 10 is mounted on the printing apparatus, a controller (not shown) in the printing apparatus is electrically connected to the memory device 17. The controller selectively reads and writes data regarding the cartridge 10 from the memory device 17. The data includes information about the amount of remaining ink. Therefore, when the cartridge 10 is remounted on the printing apparatus after being removed from the printing apparatus, the controller can determine the amount of ink remaining in the cartridge 10.

Figure 2:
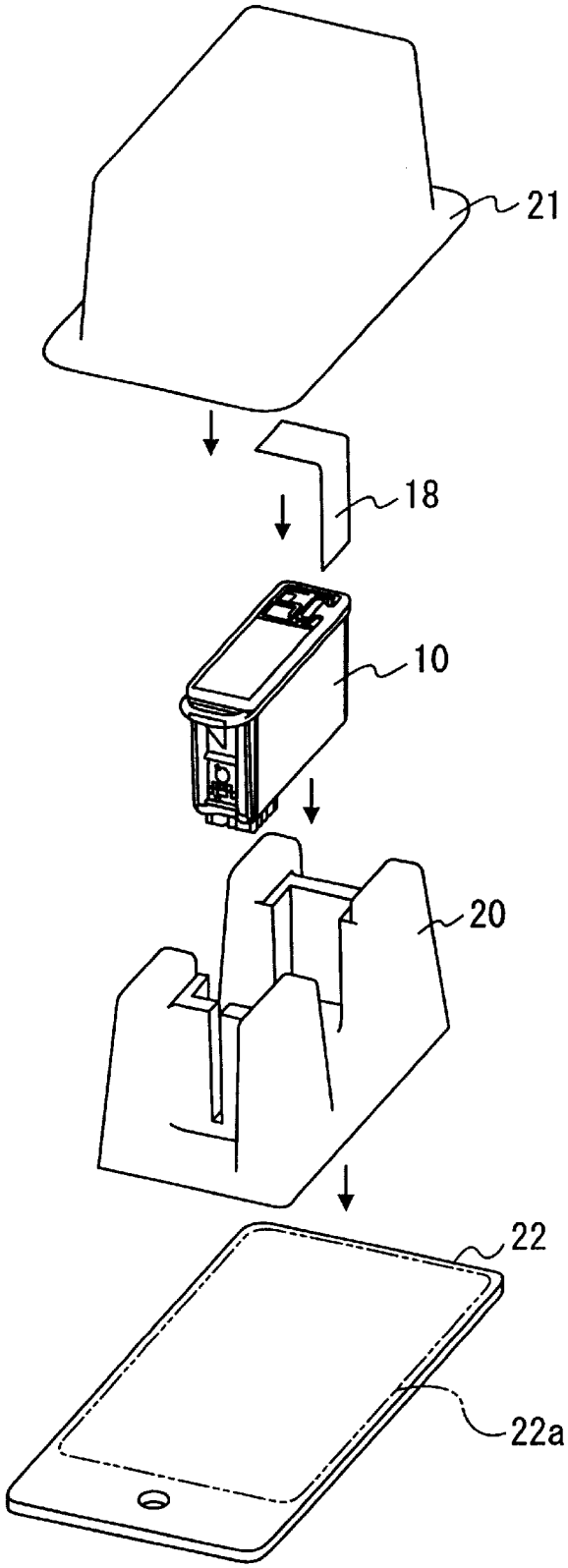
FIG. 2 is an exploded perspective view of the cartridge shown in FIG. 1(*a*) and a package for housing the cartridge.

FIG. 2 shows a package for packing the cartridge 10. The package includes a holder 20, a container 21 and a mount 22. The holder 20, which holds the new cartridge 10, is accommodated in the container 21, and the mount 22 is attached to a peripheral opening of the container 21 such that the opening of the container 21 is hermetically closed. The mount 22 is attached to the container 21 in the depressurized environment.

Figure 3A:
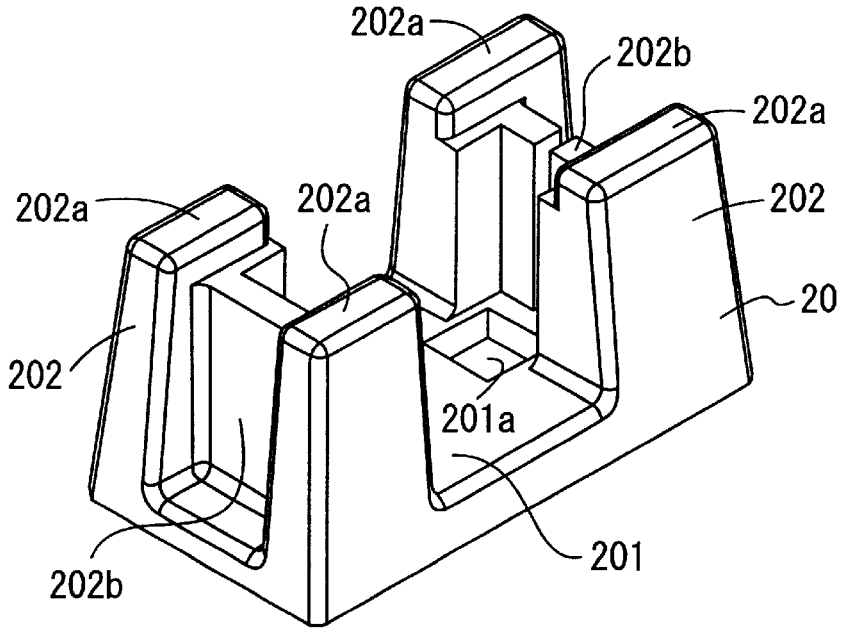
FIG. 3(*a*) is a perspective view showing a holder, which is included in the package of FIG. 2.
Figure 3B:
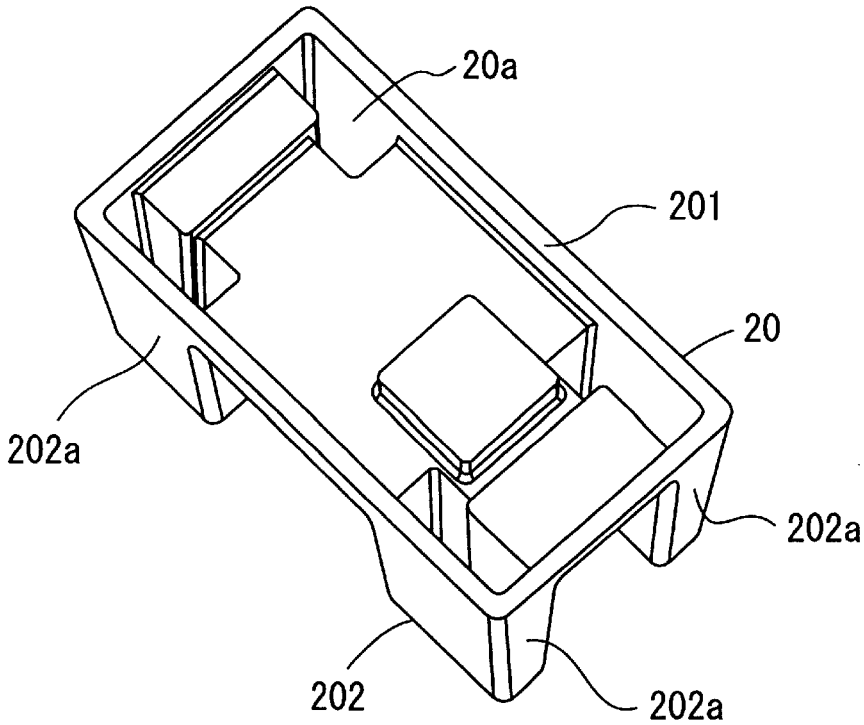

As shown in FIGS. 3(*a*) and 3(*b*), the internal shape of the holder 20 conforms to the external shape of the cartridge 10. The holder 20 is made from recycled materials such as recycled paper or a recycled resin. The holder 20 includes a rectangular base 201 and a pair of side walls 202, which are located on both sides of the base 201. The base 201 has a flat upper surface, in which an indentation 201*a* is formed. When the cartridge 10 is kept in the holder 20, the bottom surface of the container 11 is supported by the upper surface of the base 201, and the projection 14 is located within the indentation 201*a* (See FIG. 4(*b*)).

Each side wall 202 includes a pair of braces 202*a* and a regulating plate 202*b*, which is located between the braces 202*a* forming the pair. Viewed from above in FIG. 3(*a*), each side wall 202 is substantially H-shaped. The external surfaces of each pair of braces 202*a* are tapered such that the holder 20 broadens toward the base 201. Accordingly, the holder 20 is stable when resting in the position of FIG. 3(*a*). When the cartridge 10 is located in the holder 10, each side of the cartridge 10 is supported by the corresponding side wall. 202 (see FIGS. 4(*a*) and 4(*b*)). More specifically, each end of the cartridge 10 is located between one of the pairs of braces 202*a* and contacts the corresponding regulating plate 202*b*. Therefore, the cartridge 10 is tightly held in the holder 20.

The top of the holder 20 is open. The side walls 202 of the holder 20 are open in the lateral direction. The tope and the side of the holder 20 are open except for portions that are necessary for holding the cartridge 10. Accordingly, when the cartridge 10 is held in the holder 20, most of the cartridge 10 is visible. As described above, several pieces of information about the cartridge are printed on the film 13 that is attached to the lid 12 of the cartridge 10. Since the top of the holder 20 is open, all of the printed information on the film 13 is visible.

The holder 20 is light and has a relatively small volume. As shown in FIG. 3(*b*), the holder 20 is hollow. A cavity 20*a* on the back of the holder 20 reduces the weight of the holder 20 and decreases the amount of material for manufacturing the holder 20.

When the mount 22 is attached to the container 21 in the depressurized environment, the cavity 20*a* of the holder 20 is depressurized. Therefore, air in the new cartridge 10, which is hermetically contained in the package, gradually passes to the internal package through the resin wall of the cartridge 10. The cavity 20*a* of the holder 20 makes a relatively large depressurized chamber in the package. The depressurized chamber facilitates the removal of air from the cartridge to the internal package. Accordingly, while the new cartridge 10 is accommodated in the package and when the cartridge 10 is taken out of the package, the internal pressure in the cartridge 10 is sufficiently lowered. As a result, when the cartridge 10 is installed in the printer, air is restricted from entering a passage (not shown) between the ink supply port 14*a* and a printing head (not shown). Depressurization of the cartridge 10 improves the initial printing performance.

As described above, the holder 20 is designed to securely hold the cartridge 10. Therefore, when the cartridge 10 is removed from the printing apparatus while ink remains inside, the holder 20 can be used as a tray for temporarily holding the cartridge 10. Accordingly, when the cartridge 10 is taken out of the package, the holder 20 may be used.

When a cartridge 10 is removed from the printing apparatus, the supply port 14*a* of the cartridge 10 may be coated with ink. Therefore, ink from the supply port 14*a* may stain a nearby surface, or foreign matter may adhere to the supply port 14*a*. When the cartridge 10 is remounted on the printing apparatus, the foreign matter may interfere with the seal 15 and cause ink leakage. Further, when the foreign matter may enter an ink flow path (not shown) of the printing apparatus and disrupt ink flow and clog the ink flow path.

However, in the present embodiment, when a used cartridge 10 with ink inside is housed in the holder 20, the projection 14 of the cartridge 10 is positioned within the indentation 201*a* of the holder 20. Therefore, the supply port 14*a* is covered with the holder 20 (see FIG. 4(*b*)) and foreign matter is not likely to adhere to the supply port 14*a*. When the holder 20 is made from recycled paper, ink that drips from the supply port 14*a* is absorbed by the holder 20. Accordingly, ink leakage causes no significant problems. When the holder 20 is made of paper and when the ink supply port 14*a* is close to or in contact with the bottom of the indentation 201*a*, the paper absorbs ink and cleans the ink supply port 14*a*.

Figure 4A:
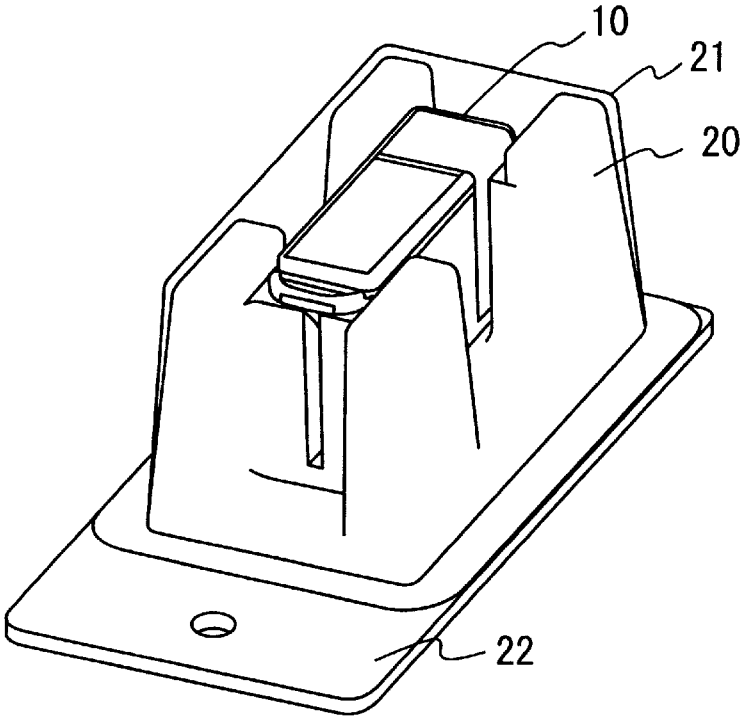
FIG. 4(*a*) is a perspective view showing a package, which packs an ink cartridge.
Figure 4B:
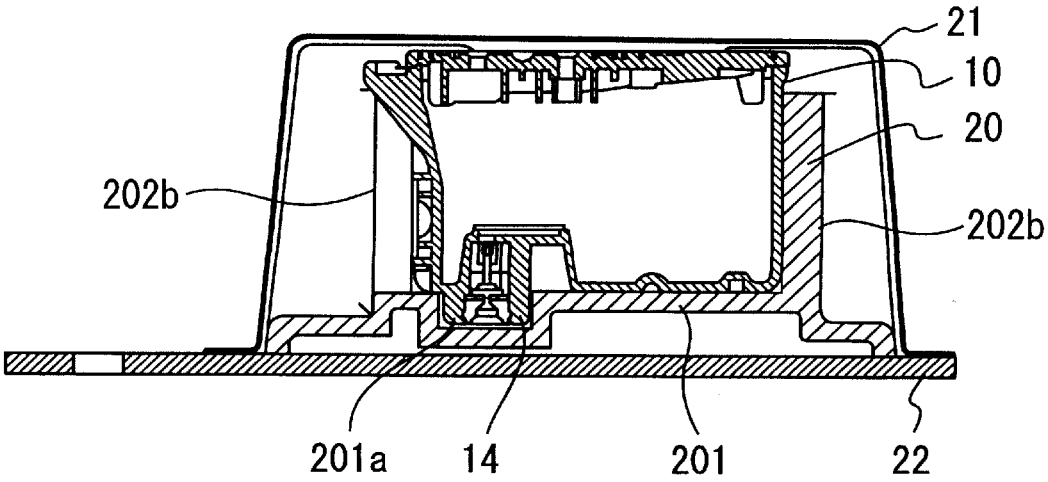

As shown in FIGS. 4(*a*) and 4(*b*), the container 21 is transparent so that the cartridge 10 is visible to potential purchasers. The container 21 is made of gas impermeable material, such as a resin. Therefore, the exposed parts of the cartridge 10 are visible. The shape of the cartridge 10 and printed information on the film 13 can be seen by potential purchasers. Alternatively, the container 21 may be partially transparent. In this case, portions of the container 21 that do not correspond to the holder 20 may be transparent.

After the cartridge 10 is taken out of the package, there is no longer a use for the container 21. Therefore, it is desirable to minimize the container volume for cost and ecological reasons. On the other hand, before opening the package, the container 21 requires strength such that the container 21 can endure differential pressure between the inside and the outside.

The container 21 partially conforms to the shape of the holder 20. The container 21 is deformed inwardly by the differential pressure. However, excessive deformation of the container 21 is prevented by contact with the holder 20. Accordingly, the container 21 does not need great strength, so the container 21 is made as thin as possible.

The mount 22, or a cover, is a sheet and is preferably made from recycled paper. As shown in FIG. 2, a gas impermeable layer 22*a* covers one entire surface of the mount 22 where the container 21 is attached. The impermeable layer 22*a* is formed, for example, by depositing a metal material on the mount 22, adhering a metal or resin film to the mount 22, or printing on the mount 22 with a resin-based ink. When the impermeable layer 22*a* is made of metal, a material such as aluminum is used. When the impermeable layer 22*a* is made of a resin, a material such as polyester, nylon or polyethylene is used. As the broken lines show in FIG. 2, the impermeable layer 22*a* may be positioned only on the part of the mount 22 that is covered by the container 21.

When the matching surface of the container 21 and the mount 22 are heated or pressurized, the container 21 is welded to the mount 22. Alternatively, the container 21 may be joined to the mount 22 by an adhesive. When the mount 22 is attached to the container 22, the impermeable layer 22*a* seals the container 21 and the mount 22. The container 21 is hermetically sealed to the mount 22, and the differential pressure between the inside and outside of the container 21 contributes to the effectiveness of the seal. Accordingly, the depressurization in the package is maintained. In addition, the container 21 and the mount 22 can be easily joined with very little adhesive. The container 21 and the mount 22 are joined without attaching them strongly to each other. When the container 21 and the mount 22 are welded, adhesive is not used, so adhesive does not remain after removing the container 21 from the mount 22. Accordingly, recycling the container 21 is easy. Since the mount 22 is made from a sheet of paper, instructions can be easily printed on the mount 22.

As described above, when the cartridge 10 is packed in the package shown, a person can match a used cartridge with a new one. Since the holder 20 and the mount 22 are made from recycled materials, harm to the environment is limited. When the cartridge 10 is removed from the printing apparatus before the ink in the cartridge 10 is depleted, the cartridge 10 can be held in the holder in good condition. It is possible to improve reliability of a cartridge 10 by cartridge 10.

In this specification, the gas impermeable material means a material that restricts gas constituents, which are contained such as in air. Therefore, it is possible to use any material with the amount of gas permeability that equals 700 [cc/m2·24 hr·25° C.] or less carbon dioxide.

The present embodiment may be modified as follows.

Figure 5:
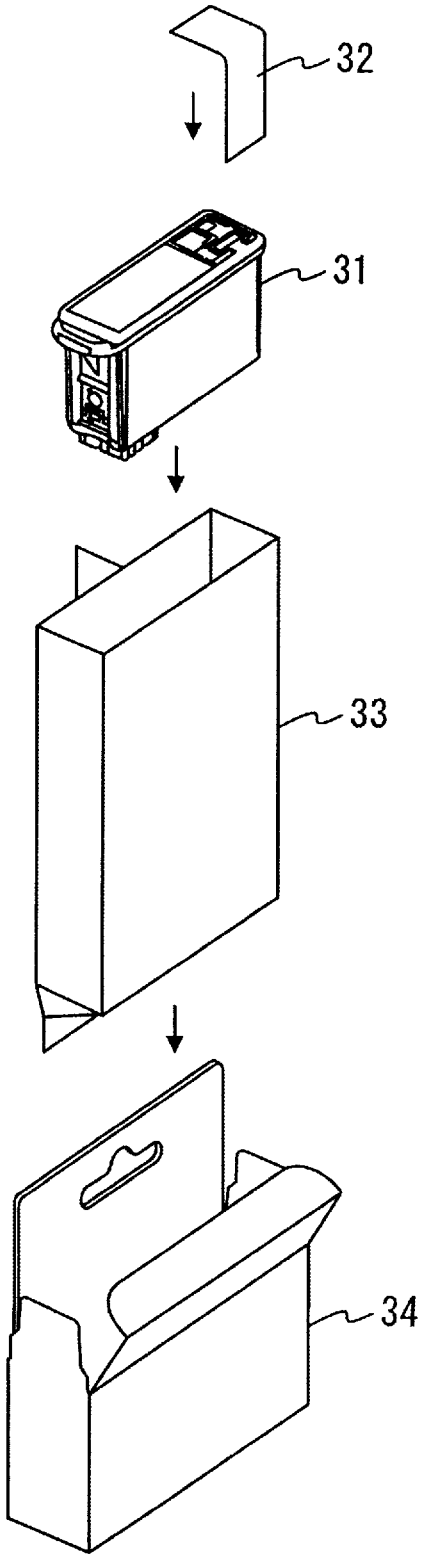
FIG. 5 (Prior Art)
FIG. 5 is an exploded perspective view of a conventional package of an ink cartridge.

As shown in FIG. 5, instead of using the container 21 and the mount 22, any bag equivalent to the conventional bag 33 may be used as a sealing member to hermetically seal the holder 20.

In the container 21, transparent portions may be relatively thin and other portions that require strength may be relatively thick.

Therefore, the present examples and embodiments are to be considered as illustrative and not restrictive and the invention is not to be limited to the details given herein, but may be modified within the scope and equivalence of the appended claims.

What is claimed is:

1. A package for an ink cartridge comprising:

a holder that supports the cartridge;

a container that accommodates the holder, wherein the container is made of a gas impermeable material and has a transparent portion and an opening; and a cover that is attached to the container such that the opening of the container is hermetically sealed.

2. The package according to claim 1, wherein the holder is made from recycled materials.

3. The package according claim 2, wherein the recycled materials include recycled paper.

4. The package according to claim 1, wherein said holder is capable of being removed from said container.

5. The package according to claim 1, wherein said cartridge is placed in said holder before said container accommodates said holder.

6. The package according to claim 1, wherein said container is depressurized.

7. The package according to claim 4, wherein the holder functions as a tray for housing the cartridge after the package is opened and the holder is removed from the container.

8. The package according to claim 1, wherein the internal shape of the holder conforms to the external shape of the cartridge, and wherein the holder is removable from the container.

9. The package according to claim 8, wherein the holder comprises:

a base; and a pair of walls, wherein the walls are located on opposite ends of the base, respectively, to hold corresponding ends of the cartridge.

10. The package according to claim 9, wherein the cartridge includes a projection in which an ink supply port is formed, and wherein the base has a recess that receives the projection.

11. The package according to claim 7, wherein the holder has a base, and the holder is tapered such that the holder increases in size towards the base.

12. The package according to claim 1, wherein the holder is hollow.

13. The package according to claim 1, wherein the container substantially conforms to the shape of the holder.

14. The package according to claim 1, wherein information is written on the cartridge, and the information is unobstructed by the holder when the cartridge is held by the holder.

15. The package according to claim 11, information is written on a label that is attached to the cartridge, wherein the transparent portion corresponds to at least the label.

16. The package according to claim 1, wherein the cover is substantially flat.

17. The package according to claim 16, wherein the cover is made from a sheet of paper and includes a gas impermeable layer at a location where the cover is attached to the container.

18. The package according to claim 1, wherein the holder includes:

a base on which the cartridge is supported;

a pair of side walls, wherein the walls are located on opposite ends on the base, respectively, to hold corresponding ends of the cartridge; and a sealing member that hermetically seals the holder, wherein the holder functions as a tray for housing the cartridge after the package is opened and the holder is removed from the container.

19. A package for an ink cartridge comprising:

a holder that supports the cartridge, wherein the holder is made from recycled materials and the internal shape of the holder conforms to the external shape of the cartridge;

a container that accommodates the holder, wherein the container is made of a gas impermeable material, has a transparent portion and an opening, and substantially conforms to a shape of the holder; and a mount that is flat and made from recycled materials, wherein the mount is attached to the container such that the opening of the container is hermetically sealed.

20. The package according to claim 19, wherein the holder comprises:

a base; and a pair of walls, wherein the walls are located on opposite ends of the base, respectively, to hold corresponding ends of the cartridge.

21. The package according to claim 20, wherein the cartridge includes a projection in which an ink supply port is formed, and wherein the base has a recess that receives the projection.

22. The package according to claim 19, wherein said holder is capable of being removed from said container.

23. The package according to claim 19, wherein said cartridge is placed in said holder before said container accommodates said holder.

24. A package for an ink cartridge comprising:

a holder that supports the cartridge, wherein the holder includes:

a base on which the cartridge is supported;

a pair of side walls, wherein the walls are located on opposite ends on the base, respectively, to hold corresponding ends of the cartridge; and a sealing member that hermetically seals the holder, wherein the holder functions as a tray for housing the cartridge after the package is opened;

wherein the cartridge includes a projection in which an ink supply port is formed, and wherein the base has a recess that receives the projection.

25. A method for packing an ink cartridge comprising:

placing the cartridge in a holder;

placing the holder in a container; and attaching a cover to the container in a depressurized environment, wherein an opening of the container is hermetically sealed to the cover.

* * * * *